US006116422A

United States Patent [19]

Rabe et al.

[11] Patent Number: 6,116,422

[45] Date of Patent: Sep. 12, 2000

[54] FROZEN DESSERT CONTAINER

[75] Inventors: Johan O. Rabe, Buffalo Grove, Ill.; Viggo Nielsen, Williams Bay, Wis.

[73] Assignee: Sealright Co., Inc., Desoto, Kans.

[21] Appl. No.: 08/935,041

[22] Filed: Sep. 22, 1997

[51] Int. Cl.[7] ..... B65D 41/00

[52] U.S. Cl. ..... 206/459.5; 220/780

[58] Field of Search ..... 229/5.5; 220/780, 220/781, 782, 794; 206/459.5

[56] References Cited

U.S. PATENT DOCUMENTS

| | | | |
|---|---|---|---|
| 2,080,685 | 5/1937 | Ashe | 220/782 X |
| 2,493,086 | 1/1950 | Reifsnyder | 220/780 X |
| 2,721,686 | 10/1955 | Reifsnyder et al. | 229/5.5 |
| 4,044,484 | 8/1977 | Ludder . | |
| 4,442,971 | 4/1984 | Helms | 220/780 X |
| 4,574,974 | 3/1986 | von Holdt | 220/782 |
| 5,316,841 | 5/1994 | Kohama et al. . | |
| 5,364,018 | 11/1994 | Carlsson . | |
| 5,417,366 | 5/1995 | Hanko et al. . | |
| 5,634,567 | 6/1997 | Hekal | 220/780 X |

FOREIGN PATENT DOCUMENTS 0722892 7/1996 European Pat. Off. .

*Primary Examiner*—Jacob K. Ackun
*Attorney, Agent, or Firm*—Shook, Hardy & Bacon LLP

[57] ABSTRACT

The present invention discloses a novel frozen dessert container. A preferred configuration for the frozen dessert container is a super-ellipse configuration. The invention allows for registered offset printing on the rim of the lid. The invention also allows for use of a single material for an entire frozen dessert container. The frozen dessert container may be composed of a fiberboard material with a polyethylene coating thereon. The present invention allows for the cost-effective fabrication of a frozen dessert container having a non-circular cross-section. The invention allows for greater sealing between the lid and the cup of the frozen dessert container.

20 Claims, 6 Drawing Sheets

Fig. 1.
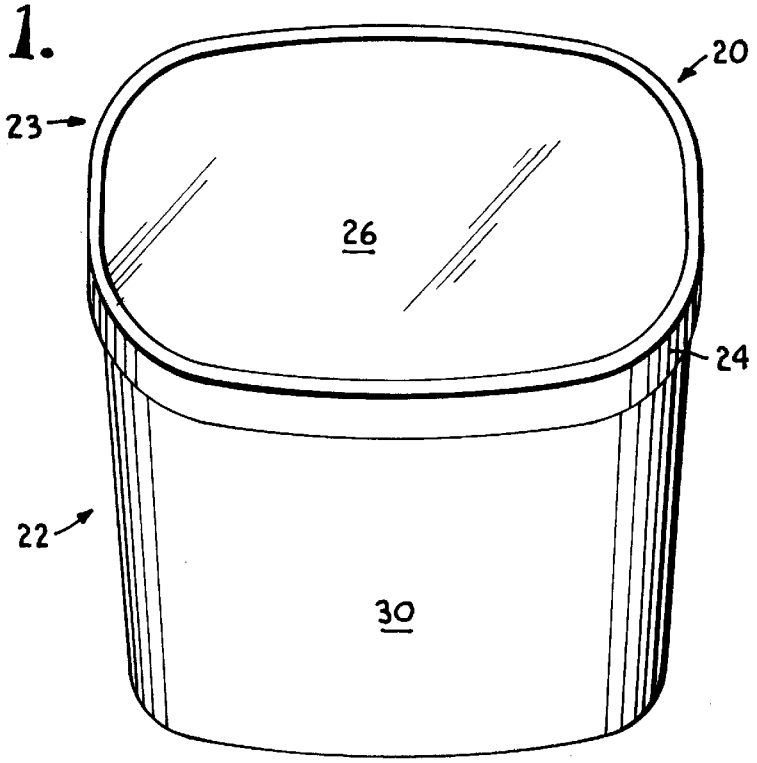
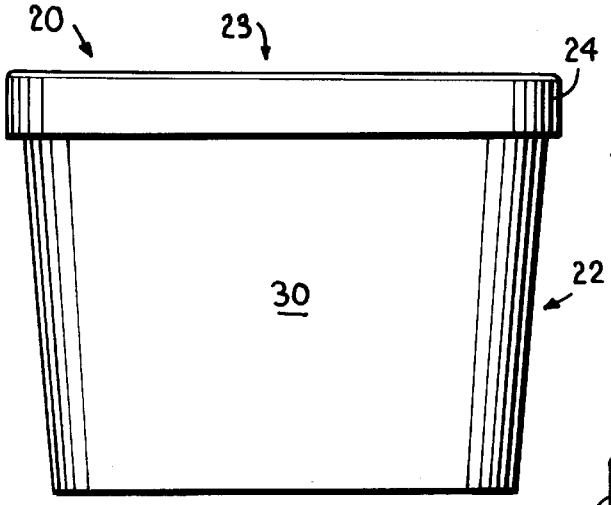
Fig. 2.
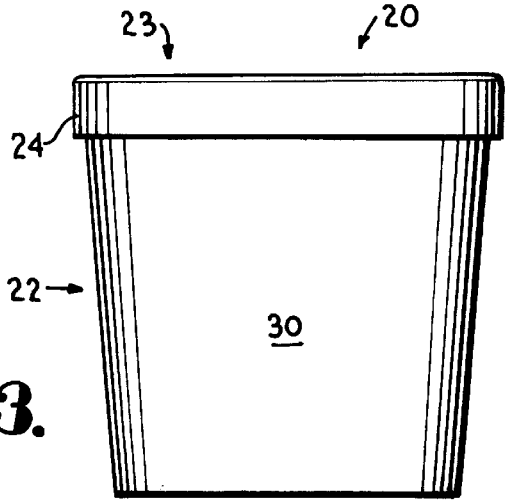
Fig. 3.

Fig.4.
(PRIOR ART)
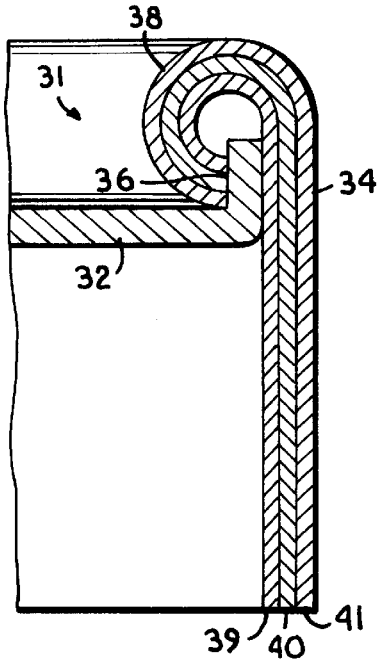
Fig.5.
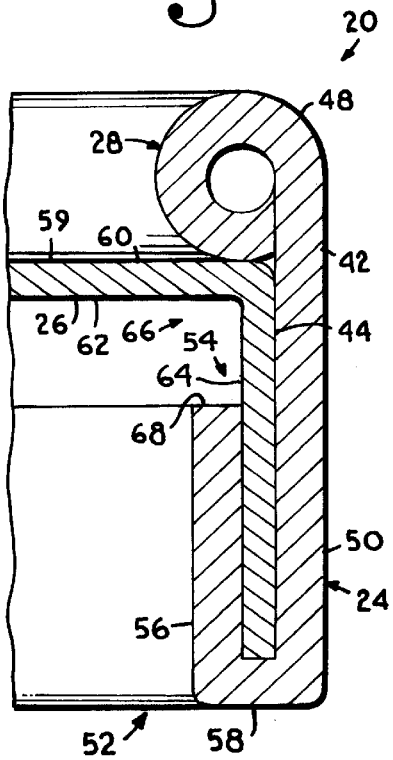
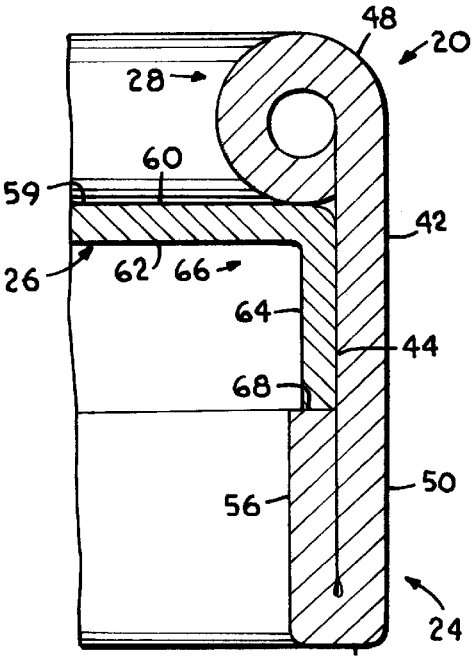
Fig. 5A.

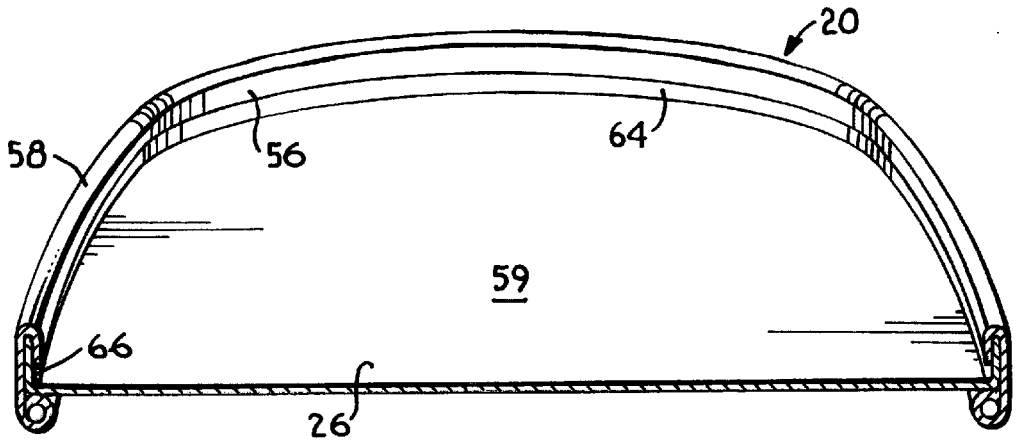
Fig. 6.
Fig. 7.
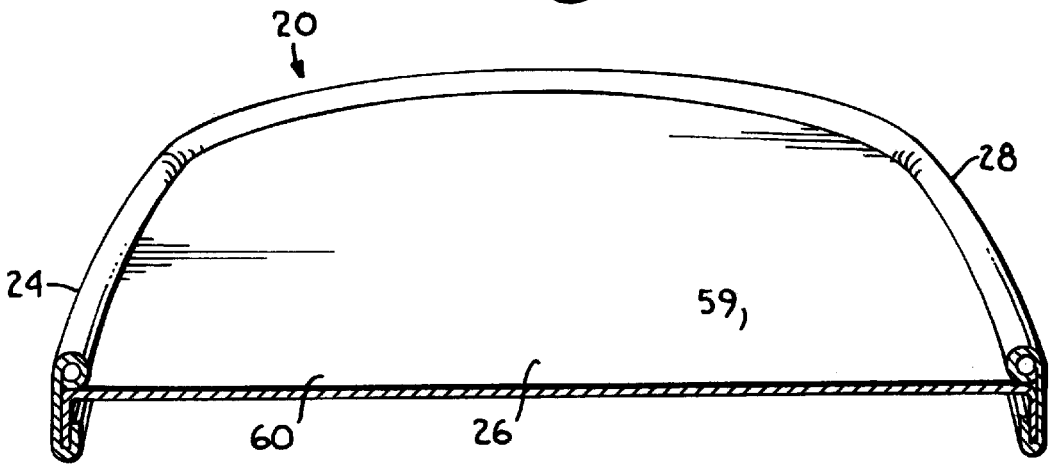

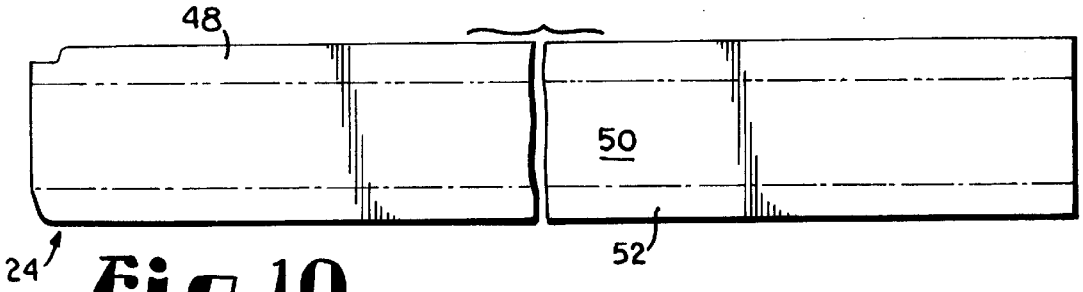
Fig. 10.
Fig. 11.
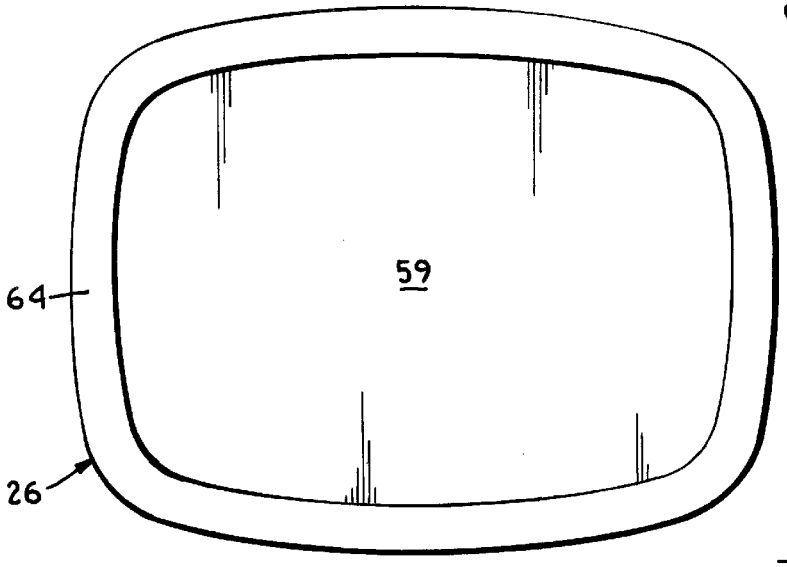
Fig. 12.
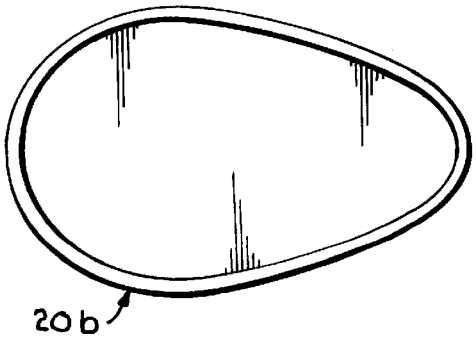
Fig. 13.
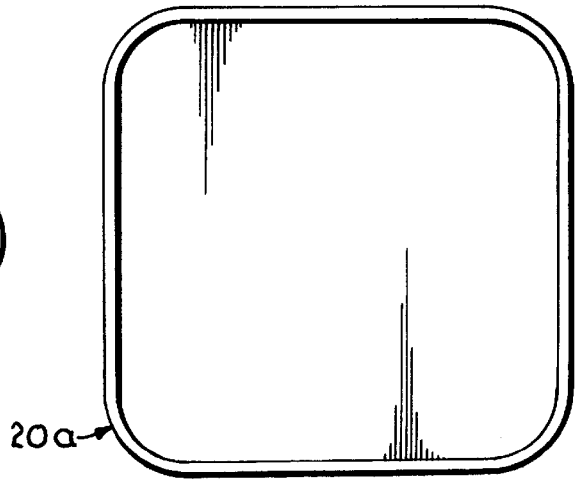

FROZEN DESSERT CONTAINER

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to lid and cup containers utilized in food packaging. Specifically, the present invention relates to a frozen dessert container.

2. Description of the Related Art

Packaging has progressed from being solely a containment means for a particular product to being the primary means for marketing a product. This progression now demands that every possible space on a package be utilized for marketing. However, fabrication techniques might render such use of space for marketing either technologically or economically unfeasible.

In the packaging of ice cream, the industry has been unable to overcome this problem. Specifically, in the packaging of ice cream in cups with lids, the industry has been unable to utilize a portion of the lid for advertising, and has been for the most part locked into using a circular cup for the packaging of ice cream in cups. The reason for this limitation to a circular cup is the fact that the lid may only be manufactured in an efficient manner as a circular lid. An example of such packaging for ice cream is the TETRA CUP® ice cream container available from Tetra Pak Hoyer of Pleasant Prairie, Wis.

In a typical process, the lid is manufactured from a spiral wound tube where three strips of paper are glued and tightly wound together to form a rim portion of the lid. Then, a circular disc is "punched" into the rim portion and glued thereto. This fabrication process limits the lid to having a circular cross-section.

In order to overcome this problem in a cost effective manner, the use of plastic rims has been put forth by the industry which allows for various shapes. However, these plastic rims do not overcome the problem with the need to utilize the space for marketing, plastic rims are more costly than paperboard rims, and plastic rims must be separated from the disc before recycling of the material. Also, the cup of these type of containers often has a flared curl which causes sealing problems.

Another concern with lids is the strength and support of the lid, and more specifically the engagement between the disc and the rim. Although the circumferential flange of the disc is glued to the rim, this does not always provide adequate strength to prevent the disc from becoming disengaged from the rim during processing.

Still another concern with current frozen dessert containers is leakage occurring during the filling process wherein a viscous product is placed into the cup, the lid is placed thereon, then the container is inverted for freezing. If the lid-cup seal is inadequate, the product will leak before freezing.

Additionally, in rectangular type containers for frozen desserts, product in the corners of the rectangular or square containers is difficult to remove and often is wasted. Another problem with these type of containers is the gripping or handling of the container with one hand.

BRIEF SUMMARY OF THE INVENTION

The present invention resolves the problems of the prior by providing a novel frozen dessert container which provides greater sealability, cost effective printability on the rim of the lid, thicker rims and variations in the shape of the container.

One aspect of the present invention is a frozen dessert container having a lid and a cup. The lid has a rim and a disc attached thereto. The rim has a curled top portion forming an edging, a central portion and a inwardly folded bottom portion thereby creating an annular recess. The disc has a perimeter portion inserted into the annular recess for attachment between the disc and the rim. The lid may be coated with polyethylene, or another polymer material (for barrier or strength properties), which allows for heat sealing between matched surfaces. The configuration of the lid will substantially match that of the cup. This configuration may be circular or non-circular. A preferred configuration is a super-ellipse.

Another aspect of the present invention is a non-circular frozen dessert container composed of fiberboard material. The rim and disc form a three-layer boundary for greater support and protection of the product therein.

Another aspect of the present invention is a container composed of fiberboard material having a snap-on lid. The top edging of the cup is such that it mates with an annular channel of the lid to allow for the snap-on feature which provides extended resealability to the container.

It is a primary object of the present invention to provide a frozen dessert container having a lid and cup where the lid may be printed with text or artwork in a cost effective manner.

It is another object of the present invention to provide a frozen dessert container composed of fiberboard material having a non-circular configuration.

It is another object of the present invention to provide a frozen dessert container having a snap-on lid.

It is an additional object of the present invention to provide a dessert container having a larger print area than containers of the prior art.

It is an additional object of the present invention to provide a frozen dessert container composed of a single material thereby facilitating recycling of the material.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a perspective view of a preferred embodiment of the container of the present invention;

Figure 8:
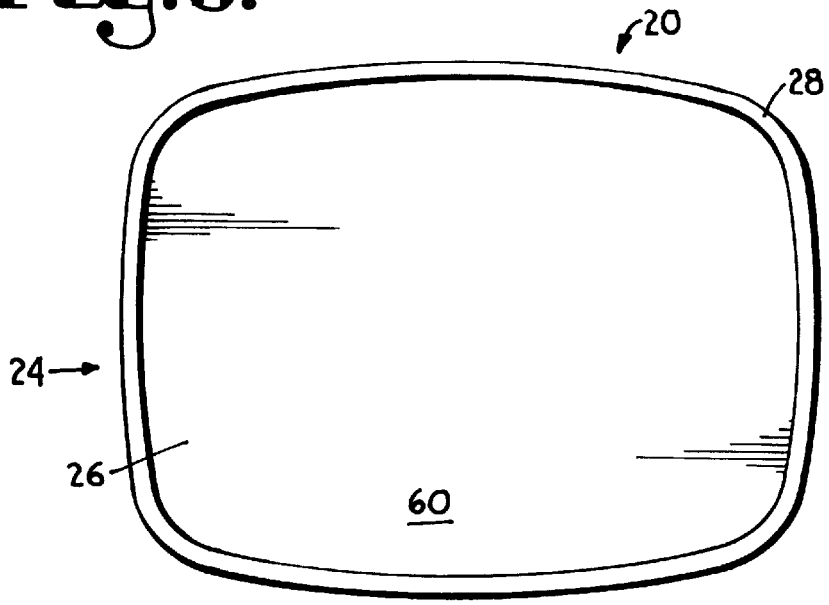
Figure 9:
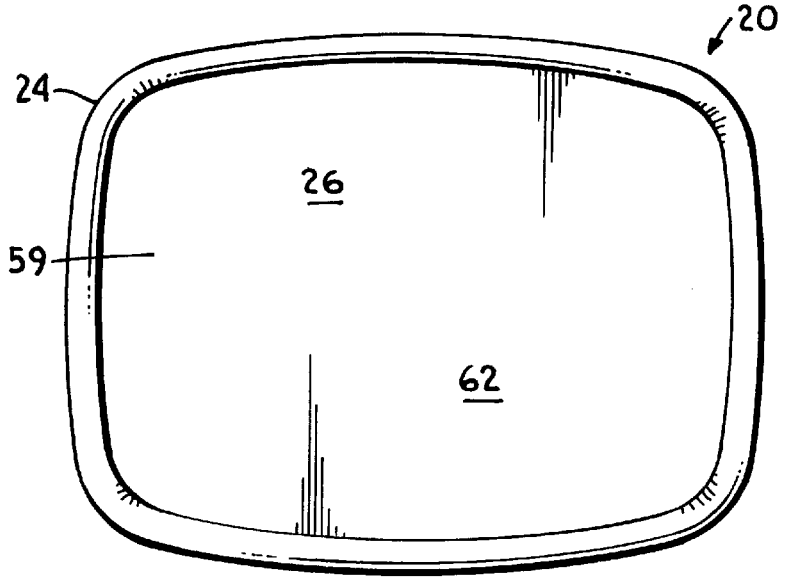
Figure 14:
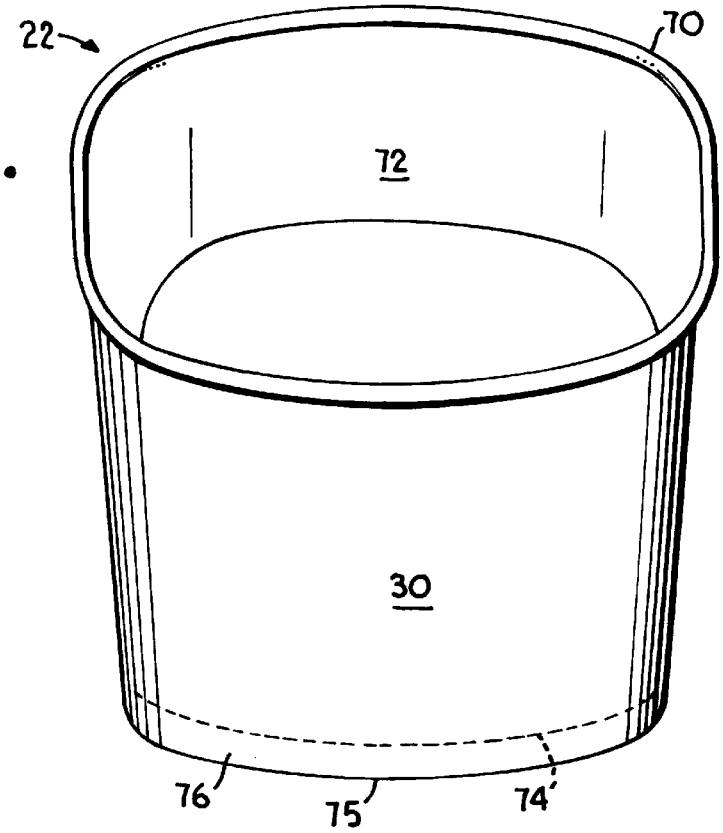
Figure 15:
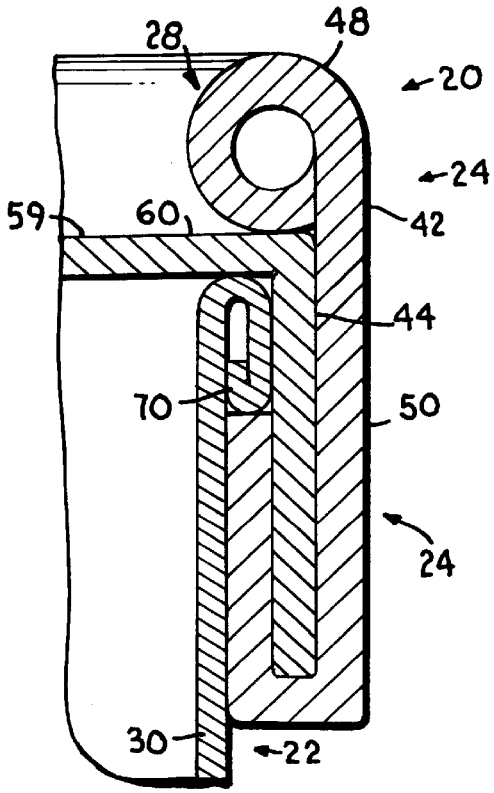

There is illustrated in FIG. 2 a front view of the container of FIG. 1;

There is illustrated in FIG. 3 an end view of the container of FIG. 1;

There is illustrated in FIG. 4 a cross-sectional view of a lid of the prior art;

There is illustrated in FIG. 5 a cross-sectional view of the lid of the present invention;

There is illustrated in FIG. 5A a cross-sectional view of an alternative lid of the present invention;

There is illustrated in FIG. 6 a perspective cut-away view of the bottom of a lid of the present invention;

There is illustrated in FIG. 7 a perspective cut-away view of the top of a lid of the present invention;

There is illustrated in FIG. 8 a top plan view of the preferred embodiment of the lid of the present invention;

There is illustrated in FIG. 9 a bottom plan view of the preferred embodiment of the lid of the present invention;

There is illustrated in FIG. 10 a plan view of a pre-formed rim of the lid of the present invention;

There is illustrated in FIG. 11 a plan view of a pre-formed disc of the lid of the present invention;

There is illustrated in FIG. 12 a top plan view of an alternative embodiment of the present invention;

There is illustrated in FIG. 13 a top plan view of another alternative embodiment of the present invention;

There is illustrated in FIG. 14 a perspective view of the open-top cup of the present invention;

There is illustrated in FIG. 15 a cut-away view of the lid engaged with the cup of the present invention.

DETAILED DESCRIPTION OF THE INVENTION

The novel container of the present invention is to be primarily utilized in the packaging of ice cream, sorbet and frozen yogurt. However those skilled in the pertinent art will recognize other applications of the lid of the present invention that are within the scope and spirit of the present invention. An open-top cup as defined herein has a continuous wall, an enclosed bottom and a top that has at least a portion open which necessitates the utilization of a lid, even if a membrane such as a plastic or aluminum foil is used to cover the open top for added protection from the environment.

As shown in FIGS. 1–3, a lid 20 is placed on cup 22 to complete a container 23 for the packaging of a desired product such as ice cream. The lid has a rim 24 and a disc 26. An edging 28 defines an intersection between the rim 24 and the disc 26. The cup 22 has a continuous sidewall 30 which defines the configuration of the cup 22. The cup 22 may have various configurations such as super-elliptical, elliptical, oval, pseudo-rectangular, circular, and the like. The lid 20 will have a corresponding configuration in order to effectively cover the cup.

The lid may be composed of a paperboard material having a polyethylene coating thereon. The use of a paperboard material allows for the cost efficient printing of text or artwork on the rim of the lid. This is possible due to a new fabrication process which is set forth in copending U.S. patent application Ser. No. 08/935,159, for a Process And Apparatus For Fabricating A Container Lid With An Inwardly Folded Rim, filed simultaneously with the present application, and which relevant parts thereof are hereby incorporated by reference.

FIG. 4 illustrates the prior art lid 31 which has a disc 32 and a rim 34. The disc has an upwardly folded portion 36 abutting the rim 34. The rim 34 has a curled top 38 engaging the folded portion 36. The disc 32 is glued to the rim 34 which provides the only attachment mechanism for this lid 31. Also, the boundary of the lid 31 as defined by the rim 34 only consists of one layer except for the very top where the folded portion 36 provides a second layer. Thus, to provide greater strength and support to the lid, the rim would have to be composed of a thicker paper during the fabrication process. Also shown in FIG. 4 is the first, second and third strips 39–41 which are glued together on the spiral to form the rim 34 of the prior art. The exterior layer 41 is often of a desired color to match the rest of the artwork that might be printed on the packaging for marketing purposes. However, printed text and artwork cannot cost efficiently be printed on this exterior layer 41.

FIG. 5 illustrates the preferred embodiment of the lid 20 of the present invention. The rim 24 has an exterior surface 42 facing away from the disc 26, and an interior surface 44 facing toward the disc 26. Both surfaces 42 and 44 may be coated with polyethylene, polyester, or the like. Alternatively, only one of the surfaces 42 and 44 may be coated with polyethylene, polyester, or the like. The rim may be divided into a top portion 48, a central portion 50 and a bottom portion 52. The bottom portion 52 is folded inwardly to create an annular recess 54. Defining the inward folding of the bottom portion 52 more specifically, the bottom portion 52 is folded substantially perpendicular to the central portion 50, then folded upward to create a parallel branch 56 of the bottom portion 52 and a perpendicular branch 58 of the bottom portion 52. The annular recess is defined by the parallel branch 56 on one side, the perpendicular branch 58 on the bottom, and the central portion 50 on the side opposite the parallel branch 56.

The top portion 48 is curled inward to form the edging 28 of the lid. This curling usually will occur subsequent to the insertion of the disc 26. The disc 26 has a main body 59 with an upper surface 60 and a lower 62. Both surfaces 60 and 62 may be coated with polyethylene, polyester, or the like. Alternatively, only one of the surfaces 60 and 62 may be coated with polyethylene, polyester, or the like. The disc 26 also has a perimeter portion 64 which is folded substantially perpendicular to the upper and lower surfaces 60 and 62, and inserted into the annular recess 54. Alternatively, the perimeter portion 64 may be formed, and then the parallel branch 56 and perpendicular branch 58 formed around the perimeter portion 64. Those skilled in the art will recognize that folding of the disc 26 and the rim 24 at various angles other than ninety degrees to create a similar engagement between the disc 26 and rim 24 is well within the scope and spirit of the present invention.

The perimeter portion 64 may be heat sealed to the interior surface 44 of the contacted portions of the rim 24 which may include the central portion 50, the parallel branch 56 and the perpendicular branch 58. The curled edging 28 abuts the upper surface 60, and may be heat sealed thereto for added strength and support. Thus, not only is the disc 26 engaged with the rim 24 mechanically, it is also engaged with the rim gravitationally and, if necessary, chemically. The mechanical engagement is the compression pressure engagement between the perimeter portion 64 and the walls of the annular recess 54. The gravitationally engagement is created by the perpendicular branch 58 and the edging 28 which, depending on how the lid is placed (normally or upside down), act as support to receive the downward force of the disc created by gravity. The chemical engagement is created by the heat sealing of the polyethylene (or other polymer coating) surfaces to one another creating chemical bonds between the surfaces. This provides greater attachment between the disc 26 and the rim 24, than the attachment of the prior art.

Still referring to FIG. 5, another benefit of the lid 20 of the present invention is the added strength and support created by the triple layer wall composed of the central portion 50, the perimeter portion 64 and the parallel branch 56. Comparing FIG. 4 and FIG. 5, the triple layer wall of the lid 20 is almost three times as thick as the single layer wall of the lid 31 of the prior art. The three strips 39, 40 and 41 of the prior art lid 31 represent thinner paperboard material in order to achieve the structure of the lid 31. If the paperboard thickness of rim 24 was used for each of the layer 39, 40 and 41, then adjustments would need to be made to the curled portion 38 and the cup of the prior art because the thicker rim 34 would fit differently. Also, the entire engagement of the disc 32 with the rim 34 at the folded portion 36 would be compromised due to the thicker paper. Whereas the lid 20 of the present invention may use various paperboard thickness since the engagement of the disc 26 and the rim 24 would not be compromised, the ability to vary the thickness of the wall of the lid greatly increases the application of the lid of the present invention. Also, the ability to have a triple layer thickness from essentially a single layer allows for greater savings in material and less waste.

Again referring to FIG. 5, an annular channel 66 is defined by a projecting end 68 of the bottom portion 52, a part of the perimeter portion 64, and a part of the lower surface 62 of the disc 26. The annular channel 66 may engage with the top of a cup, not shown, for added sealability of the cup and the lid, thereby creating not only an interference fit, but also a gravitational and geometric fit. This tremendously enhanced sealability prevents leaking of the product which might occur during filling wherein the cup is filled with a viscous "frozen" dessert product, the lid is placed thereon, and the container is inverted for freezing the product.

FIG. 5A illustrates a variation on the folding of the bottom portion 52. In this variation, the parallel portion 56 is mated with the central portion 50 thereby creating a shoulder at the projecting end 68 for the perimeter portion to rest upon. Also, the annular recess 54 is removed from this variation.

FIGS. 6 and 9 illustrate the bottom of the lid 20. The parallel branch 56 continually engages the perimeter portion 64 of the disc 26. The annular channel 26 also continues about the perimeter of the body 59 of the disc 26. FIGS. 7 and 8 illustrate the top of the lid 20. The edging 28 of the rim 24 continually engages upper surface 60 of the main body 59 of the disc 26.

FIG. 10 illustrates a preformed rim 24 of the present invention prior to folding of the rim 24. The central portion 50 is bounded by top portion 48 and bottom portion 52. The top portion 48 and the bottom portion 52 may have various dimensions depending on the needs of the lid. FIG. 11 illustrates a pre-formed disc 26 with the main body 59 bounded by perimeter portion 64. The perimeter portion 64 may have various dimensions depending on a needs of the lid 20. The configuration of the body 59 will also be the major factor in determining the configuration of the lid 20. The body should have a configuration substantially similar to that of the cup 22 for which the lid 20 is intended to cover. A preferred configuration is a super-ellipse, which is the joining of two ellipses. Other possible configurations are set forth in FIGS. 12 and 13. The possibilities include circular and non-circular configurations. The prior art is limited to circular configurations due to the fabrication process used in the prior art.

The lid 20 of the present invention allows for greater printing of the rim 24 of the lid, for example, as shown in FIG. 1, "Tetra Pak Hoyer®", which was unavailable for the prior art. Particularly, registered offset printing using a sheet fed printer allows for accurate registration and no overlapping of the print as is common with the prior art technology of spiral wound lids. The printing may take place at the same facility where the printing of the side of the cup is performed thereby providing for greater savings. Also, the recess wall area of the cup 22 provides an even greater area for printing on the frozen dessert container.

The cup 22 of the present invention is shown without the lid 20 in FIG. 14. The cup 22 has an outwardly curled edging 70 which forms the top perimeter of the cup 22. The edging 70 is continuous around the perimeter and engages with the annular channel of the lid to form a snap-on seal. The interior 72 of the sidewall 30 illustrates the depth of the cup 22. The surface walls of the interior 72 may or may not be coated with polyethylene. The dashed line 74 illustrates the bottom recess 75 of the cup 22. The recess wall 76 provides added space for printing on the cup. Also, the recess 75 and recess wall 76 create a non-chilled or reduced chilled gripping area for handling the container. The gripping is also enhanced by the tapered sidewall 30 of the cup 22 which has a gradually reduced the circumference from top to bottom wherein circumference is defined as the perimeter of any given cross-section of the cup 22.

The engagement of the lid 20 and the cup 22 is shown in FIG. 15. The edging 70 rests in the annular channel and is bounded on one side by the central portion 50 of the rim, on the top by the inwardly curled edge and on the bottom by the perimeter portion of disc. This triple bounding allows for the snap-on sealing and resealing. It also extends the life of the resealing. The triple bounding also adds greater sealing to protect the product from the environment and any possible contaminants. Also, the sealing between the cup and lid is greatly enhanced to prevent leakage. This tremendously enhanced sealability prevents leaking of the product which might occur during filling thereby ruining in the container.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A frozen dessert container comprising:

a cup having a predetermined configuration defined by a continuous sidewall, the cup having a closed bottom and an open top, the top of the continuous wall having an outwardly curled edging; and a lid having a rim and a disc, the rim having exterior and interior surfaces, a top portion curled inwardly toward the interior surface to form an edging, a bottom portion folded inwardly to form an annular recess, the disc having upper and lower surfaces and a perimeter portion folded substantially perpendicular to the upper and lower surfaces, the perimeter portion inserted into the annular recess.

2. The container according to claim 1 wherein the cup and the lid are composed of a fiberboard material with a polyethylene coating thereon.

3. The container according to claim 2 wherein the perimeter portion of the disc is heat sealed to the interior surface of the rim.

4. The container according to claim 1 wherein the cup and the lid have cross-sections of a superellipse.

5. The container according to claim 1 wherein the cup and the lid have cross-sections of an oval.

6. The container according to claim 1 wherein a portion of the upper surface of the disc abuts the inwardly curled edging of the rim.

7. The container according to claim 1 wherein the cup and the lid have non-circular cross-sections.

8. The container according to claim 1 wherein the rim has printing thereon.

9. The container according to claim 1 wherein the inwardly folded bottom portion of the rim has an upwardly projecting end, the lid having an annular channel for receiving the outwardly curled edging of the cup, the annular channel defined by the upwardly projecting end, the lower surface of the disc and the perimeter portion of the disc.

10. A container for packaging of a frozen food, the container comprising:

an open-top cup having a continuous sidewall defining the configuration of the cup, the top of the cup having an outwardly curled edging;

a lid having an annular channel for engaging with outwardly curled edging of the cup, wherein the lid further comprises a rim and a disk, the rim having a first end and a second end sealed together to form a continuous rim substantially matching the predetermined configuration of the cup, the rim having exterior and interior surfaces, a top portion curled inwardly toward the interior surface to form an edging, and a bottom portion folded inwardly to form an annular recess, the disk having upper and lower surfaces and a portion folded substantially perpendicular to the upper and lower surfaces, the perimeter portion inserted into the annular recess; and wherein the engagement of the outwardly curled edging and the channel interconnects the lid to the cup.

11. The container according to claim 10 wherein the lid is composed of a fiberboard material with a polyethylene coating thereon.

12. The container according to claim 11 wherein the perimeter portion of the disc is heat sealed to the interior surface of the rim.

13. The container according to claim 10 wherein the container has a non-circular cross-section.

14. The container according to claim 10 wherein the rim has registered offset printing thereon.

15. In combination:

a open-top cup having a continuous sidewall defining the configuration of the cup, the top of the cup having outwardly curled edging; and an lid comprising a rim and a disc, the rim having a top, central and bottom portions, the top portion curled inwardly toward the interior surface to form an edging, the central portion defining a continuous first layer and a bottom portions folded inwardly to form an annular recess and to define a second layer, and the disc having a perimeter portion folded into the annular recess, the perimeter portion defining a third layer;

whereby the lid provides a three-layer boundary for greater support and protection of the product therein.

16. In combination:

a cup having a predetermined configuration defined by a continuous sidewall, the cup having a closed bottom and an open top, the top of the continuous wall having an outwardly curled edging; and a lid having a rim and a disc, the rim having exterior and interior surfaces, a top portion curled inwardly toward the interior surface to form an edging, a bottom portion folded inwardly to form an annular recess, the disc having upper and lower surfaces and a perimeter portion folded substantially perpendicular to the upper and lower surfaces, the perimeter portion inserted into the annular recess.

17. The container according to claim 16 wherein the cup and the lid have non-circular cross-sections.

18. The container according to claim 16 wherein the rim has printing thereon.

19. The container according to claim 16 wherein the cup and the lid have cross-sections of a superellipse.

20. The container according to claim 16 wherein the cup is tapered and has a recessed bottom.

* * * * *